United States Patent [19]

DeVizzi

[11] Patent Number: 4,860,162

[45] Date of Patent: Aug. 22, 1989

[54] MOLDED CASE AND COVER ARRANGEMENT FOR CURRENT LIMITING CIRCUIT INTERRUPTERS

[75] Inventor: Francesco DeVizzi, Sangiuliano Milanese, Italy

[73] Assignee: General Electric Company, New York, N.Y.

[21] Appl. No.: 250,593

[22] Filed: Sep. 29, 1988

[51] Int. Cl.[4] ..... H01H 33/02

[52] U.S. Cl. ..... 361/376; 220/74; 174/52.1; 200/303

[58] Field of Search ..... 361/115, 331, 356, 357, 361/363, 376; 200/293, 294, 296, 303 X, 306, 307, 144 R, 147 R; 174/52.1 X, 92; 220/72, 74 X, 356; 335/201, 202 X

[56] References Cited

U.S. PATENT DOCUMENTS 3,422,235 1/1969 Camp ..... 200/147

4,527,027 7/1985 Link et al. ..... 200/144

*Primary Examiner*—Gerald P. Tolin

*Attorney, Agent, or Firm*—Richard A. Menelly; Walter C. Bernkopf; Fred Jacob

[57] ABSTRACT

An insulating plastic case and cover for a circuit breaker having complementary extensions on the cover and recesses on the base side walls to transfer internal stress from the base side walls to the cover during circuit interruption.

12 Claims, 4 Drawing Sheets

MOLDED CASE AND COVER ARRANGEMENT FOR CURRENT LIMITING CIRCUIT INTERRUPTERS

BACKGROUND OF THE INVENTION

This invention relates to a unique insulating enclosure for low voltage current limiting circuit breakers and, more specifically, to the interconnection between the case and the cover of the enclosure to allow the enclosure to strongly resist the overpressure caused by gases generated during the interruption process.

As already known, particularly high circuit currents generate gas pressure in the order of several P.S.I. in the arc chambers of current limiting circuit breakers due to gases generated by the contacts of the circuit breakers as well as the other components contributing to the arc extinction process.

The standard insulating molded plastic enclosure for such low voltage circuit breakers consists of an enclosure, which contains the circuit breaker components, provided with a cover having openings for an operating handle.

The cover is usually attached to the base by screws passing through the cover itself to engage threaded openings in the case. Additionally, the cover includes projecting ridges for accurate alignment with the case.

The high gas pressure, generated when a short circuit occurs, exerts a strong mechanical stress to the side walls of the case which ordinarily is incapable of resisting such high pressure. Accordingly, it is considered beneficial to transfer such stress from the side walls of the case to the cover which is more capable of resisting stress because of the reduced height and increased thickness of the cover.

One prior attempt to transfer the stress from the circuit breaker case to the cover provided a step on the upper edge of the side walls of the case having a lower portion towards the exterior of the case and an upper portion towards the interior of the case. A complementary step was also provided on the lower edge of the side walls of the cover. This arrangement allowed for cases and covers of equal thickness but required a decrease in the thickness of the steps themselves which ultimately reduced the overall resistance of the enclosure to stress. Increasing the thickness of the steps caused the overall dimensions of the enclosure to become increased and also interfered with the rapid venting of the gases to the exterior of the enclosure.

Another known method of reinforcing the enclosure consisted of providing a number of metal pins in the edge of the cover received within corresponding recesses formed in the cross-section of the side walls of the case. The method was effective for increasing the resistance of the enclosure to stress but resulted in an increase in the overall cost of manufacturing the cover and the case.

SUMMARY OF THE INVENTION

The invention comprises a current limiting circuit breaker enclosure having a case and a cover which include a plurality of dovetail interconnections to provide increased stress resistance to the enclosure. The cover is provided with dovetail projections having edges that taper inwardly toward the cover while the case is provided with corresponding slots which taper outwardly from the case to receive the dovetail projections.

A further embodiment includes a metal tang embedded within the dovetail projections on the cover to provide increased stiffness to the dovetail projections.

DESCRIPTION OF THE PREFERRED EMBODIMENT

Figure 1:
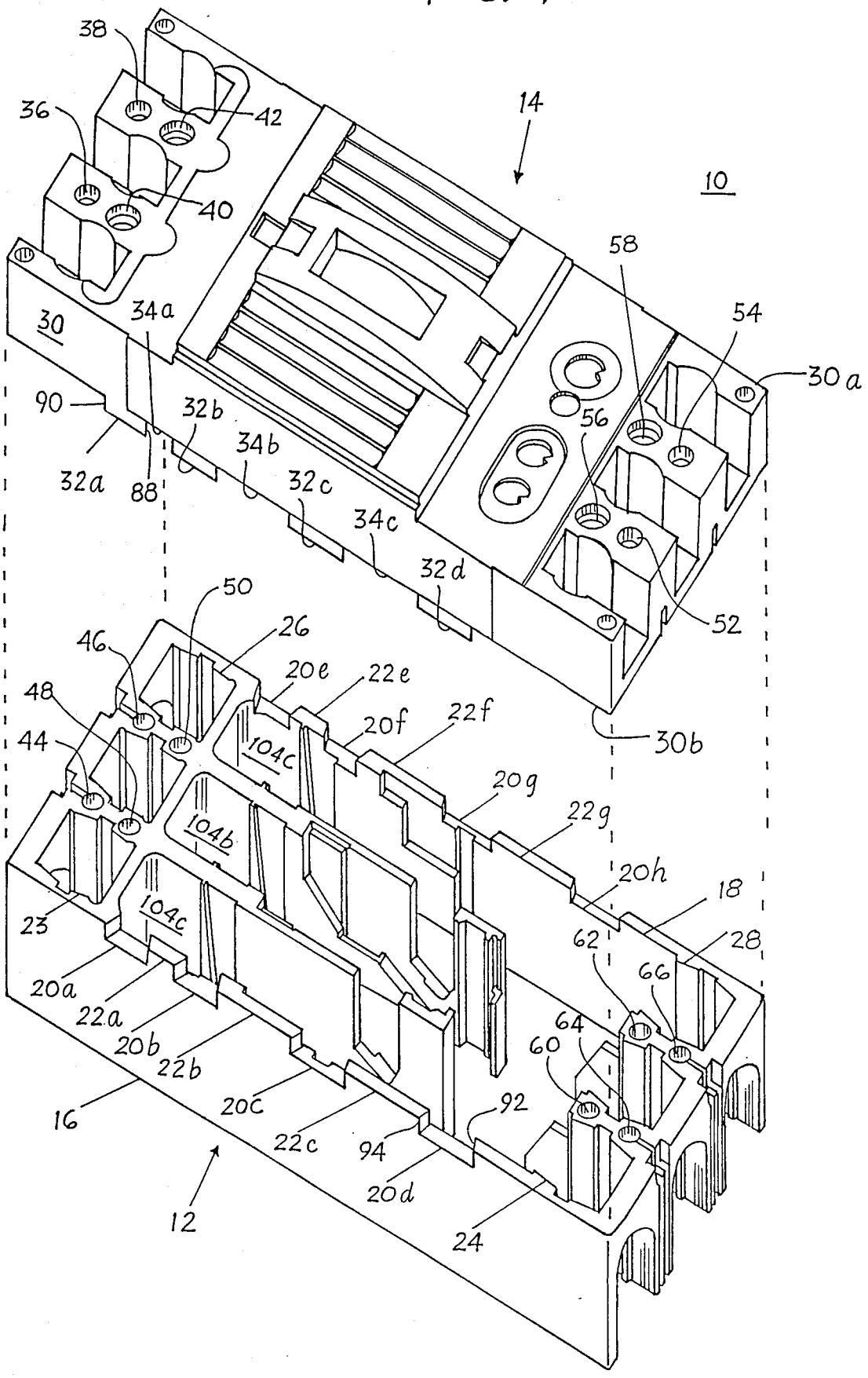
FIG. 1 is a top perspective view in isometric projection of a molded insulating enclosure featuring the interconnection between the case and cover according to the invention.

The molded plastic insulating enclosure 10 shown in FIG. 1 is designed for a current limiting circuit breaker, according to the invention and consists of a case 12 which houses the components of the low voltage circuit breaker (not shown) and a cover 14. The case includes two side walls 16 and 18 which are particularly exposed to outwardly directed stresses which occur upon short circuit interruption whereby the gases developed in the arc chambers of the circuit breaker generate such a high internal pressure that side walls would otherwise camber and move away from each other. The upper edges of the side walls 16 and 18 have, at both ends, areas defined at 23, 24, 26 and 28 respectively which are separated by recesses 20*a*, 20*b*, 20*c*, 20*d*, 20*e*, 20*f*, 20*g* and 20*h*, alternated with outwardly tapered protrusions 22*a*, 22*b*, 22*c*, 22*e*, 22*f* and 22*g*. Each of the protrusions is defined by a narrow exterior surface and a wider interior surface.

The cover is provided with a pair of opposing side walls 30A, 30B. A plurality of dovetail-shaped projections 32*a*, 32*b*, 32*c*, 32*d* alternate with recesses 34*a*, 34*b*, 34*c* which reciprocally align with the protrusions 22*a–d* of the corresponding side wall 16 as best seen by referring to FIG. 2.

A pair of thru-holes 36 and 38 on one end of the cover 14 aligns with the corresponding threaded holes 44 and 46 in the case 12, for attaching the cover to that side of the case 12. A similar pair of thru-holes 52 and 54 on the opposite side of the cover aligns with a corresponding pair of threaded holes 64 and 66 in the case for attaching the opposite end of the cover to the case as shown in FIG. 1. The remaining thru-holes 40, 42, 56 and 58 in the cover respectively align with corresponding thru-holes 48, 50, 60 and 62 in the case to allow for attaching the circuit breaker within a panel-board.

Figure 4:
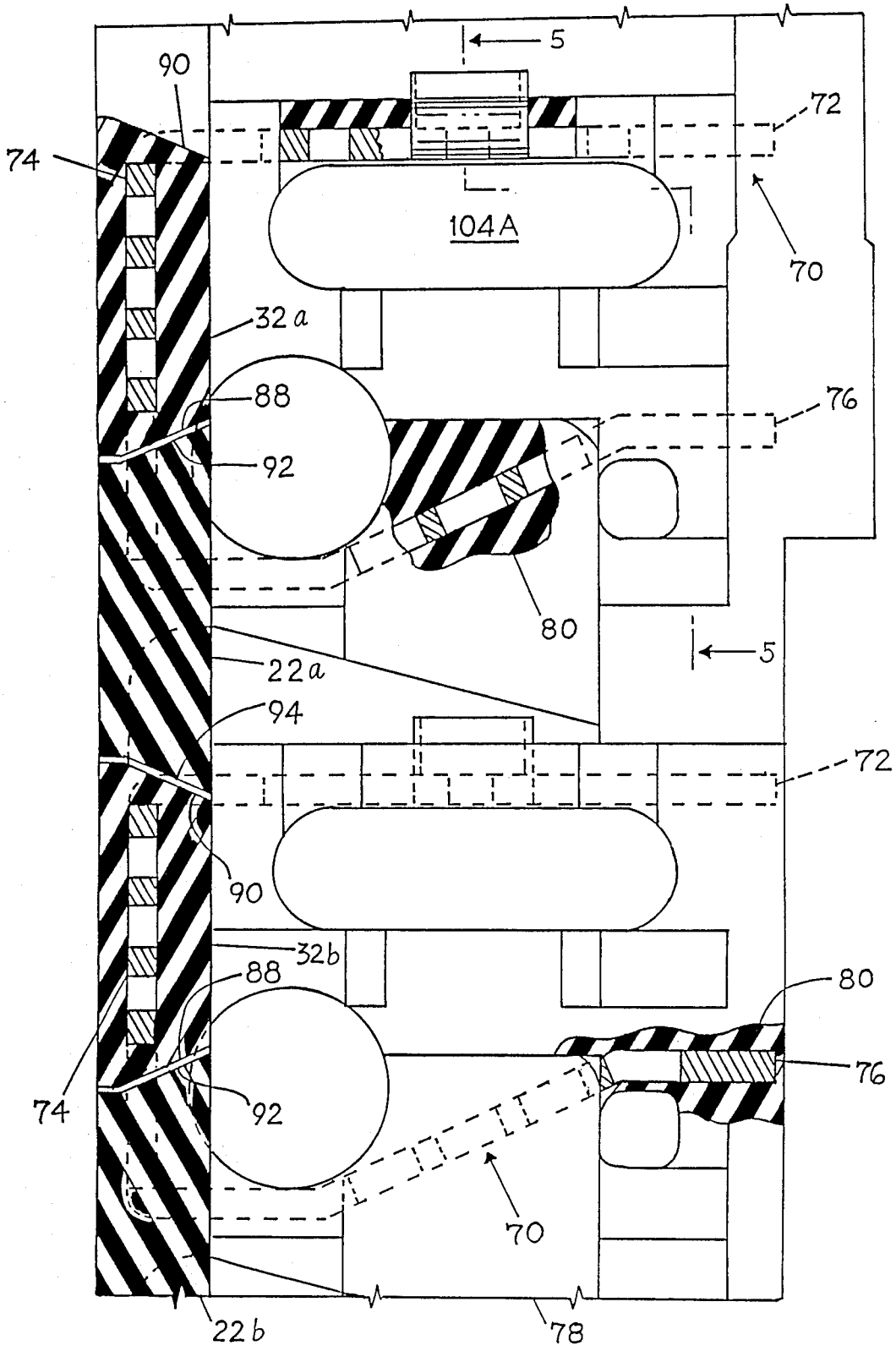
FIG. 4 is an enlarged sectional view of a part of the cover of FIG. 1 containing a metal bracket embedded in the cover.
Figure 5:
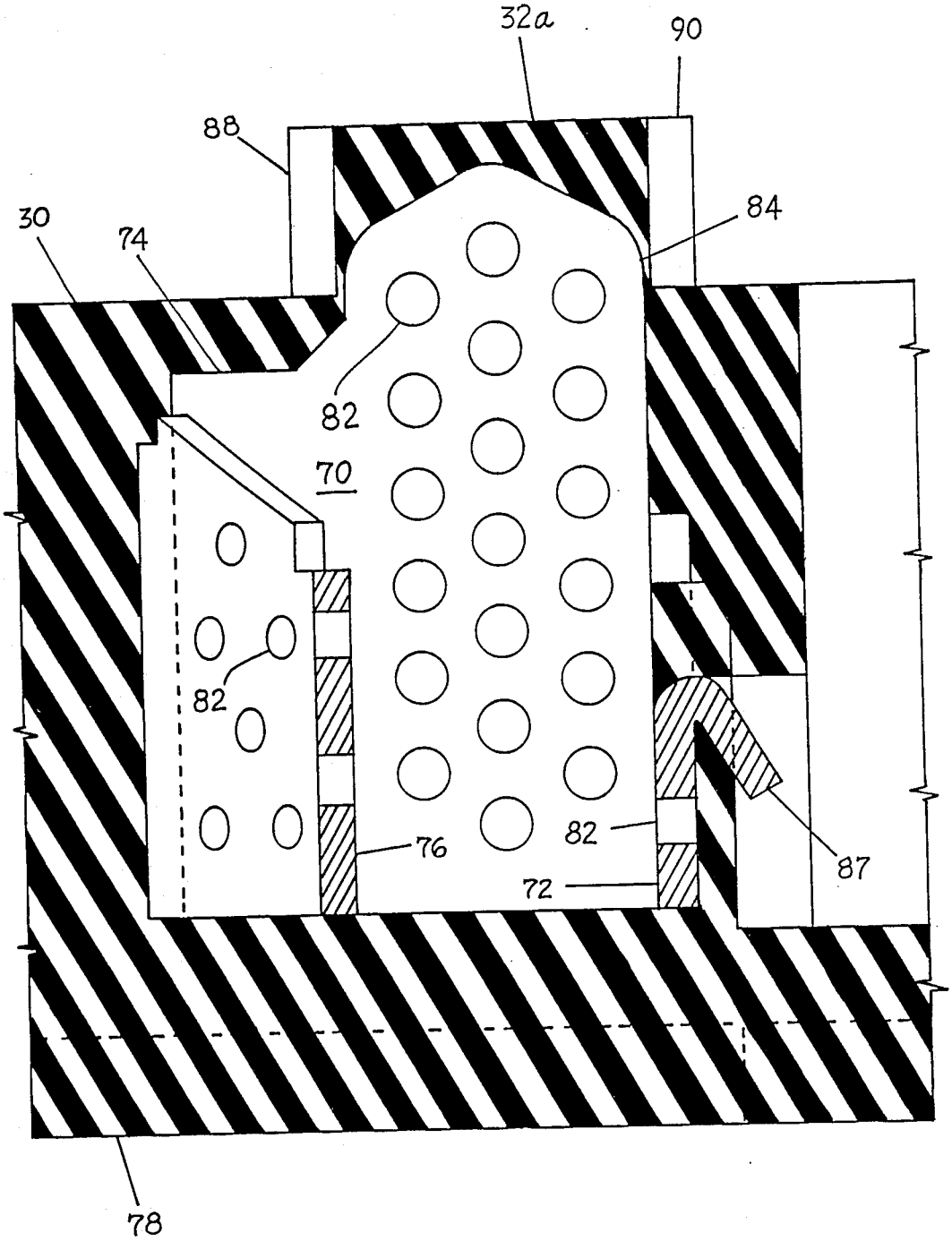
FIG. 5 is a cross-section view along the plane 4—4 of the cover depicted in FIG. 4.

Means for providing additional support to the dovetail projections 32*a–d* on the side walls 30A, 30B of the cover 14 are shown in FIGS. 4 and 5. Such additional support consists of a U-shaped sheet metal bracket 70 embedded in the top and side walls of the cover itself. The U-shaped bracket includes a first leg 72, extending from the interior to the exterior of the cover, a bight 74 and second leg 76 extending from the exterior to the interior of the cover. The legs 72, 74, and bight 76 are embedded in the molded top part of the cover 14 so that the entire bracket 70 is embedded in the insulating plastic material forming the cover as indicated at 80. For good adhesion between the bracket 70 and the plastic material 80 a plurality of holes 82 are formed in the metal sheet of the bracket. The holes become filled with the plastic material 80 during the molding process.

A tail piece 84 best seen in FIG. 5, protrudes from yoke 74 of the bracket 70 which extends into the protrusions of the lateral wall of the cover to enhance the strength of the dovetail projections as depicted at 32*a* in FIG. 5. As described earlier, the dovetail projections such as 32*a*, 32*b* in FIG. 4 are provided with tapered edges which complement corresponding tapered edges 92, 94 and the recesses 20*a–d* in the side walls of the case 12.

Figure 2:
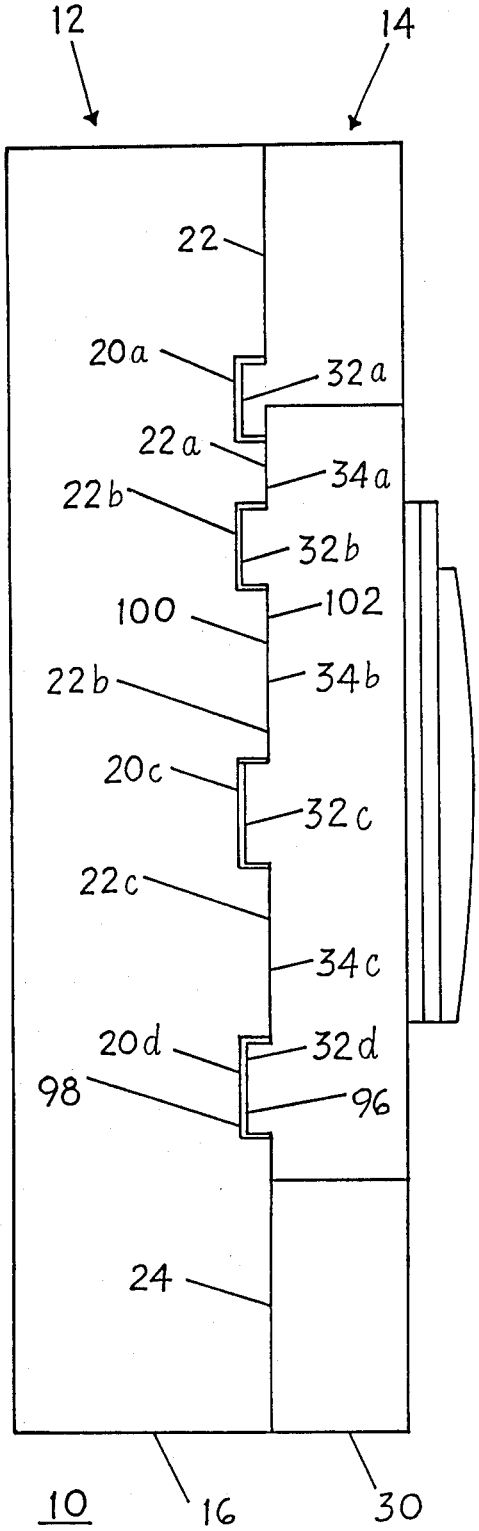
FIG. 2 is a side view of the molded insulating enclosure shown in FIG. 1.
Figure 3:
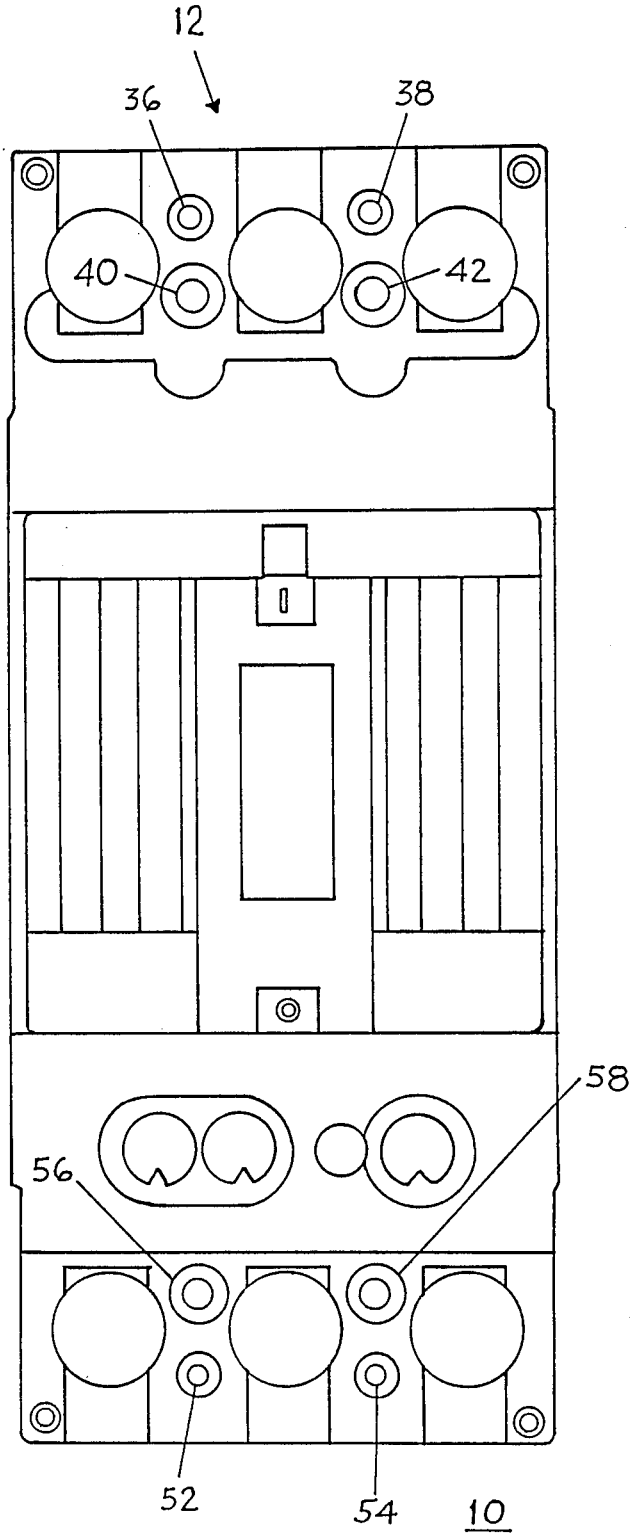
FIG. 3 is a plan view of the molded insulating enclosure of FIG. 2.

As depicted in FIG. 2, the gaps between the tops 96 of the dovetail 32*a–d* of the cover 14 and the bottoms 98 of the recesses 20*a–d* of the case 12 permit a limited amount of gas venting from the enclosure 10. There are no gaps between the tops 100 of the protrusions 22*a–d* of the case and the bottoms 102 of the recesses 34*a–d* of the cover in order to insure that the cover sits solidly on the case.

The operation of the attachment between the cover and the case of the enclosure 10 of the invention is best understood by referring back to FIG. 1. When a short circuit causes the opening of the contacts (not shown) within the arc extinguishing chambers 104*a*, 104*b* and 104*c*, the arc gases generated between the separated contacts exert a large gas pressure on the interior surface of the enclosure 10. The gas pressure against the side walls 16 and 18 of the case ordinarily causes the side walls to bend and could even cause the side walls to break in the immediate vicinity of the arc chambers. The enclosure of the invention, however, prevents this from occurring by transferring the gas pressure from the side walls of the case over to the side walls of the cover. Since the side walls of the cover are shorter than the side walls of the case, they are more resistant to the gas pressure than the case side walls. This transferral of gas pressure from the case to the cover is achieved by abutment between the tapered edges 92 and 94 of the recesses 20*a–h* of the side walls 16, 18 of the case against the tapered edges 88 and 90 of the recesses 32*a–d* of the cover 14 as depicted in FIGS. 1 and 4. When excessively large gas pressures are anticipated, it is expedient to strengthen the dovetail projections 32*a–d* by insertion of the U-shaped brackets 70 described earlier with reference to FIGS. 4 and 5. The U-shaped brackets receive the gas pressure through the tail piece 84 when embedded in the body of the dovetail projections and transfer the gas pressure to the top 78 of the cover by means of legs 72 and 76. As depicted in FIG. 5, the operation of the bracket 70 is insured by an accurate positioning of the tang 84 inside the body of the dovetail projection 32*a*. This positioning is obtained by using the folded tang 87 as a reference point which, in turn, allows the bracket 70 to be positioned within the mold during the manufacturing of the cover 14 itself.

Having thus described my invention, what I claim as new and desire to secure by Letters Patent is:

1. A circuit breaker enclosure comprising:

a molded plastic cover and a molded plastic case including means for supporting circuit breaker terminals thereon;

said cover including a pair of opposing side walls each having a plurality of dovetail projections extending therefrom, said case including a pair of complementary side walls having a corresponding plurality of recesses formed therein, said recesses receiving said dovetail projections; wherein said dovetail projections each comprise a pair of opposing interior and exterior surfaces, said exterior surfaces being larger than said interior surfaces.

2. The circuit breaker enclosure of claim 1 wherein said opposing interior and exterior surfaces are joined by tapering edges, said edges tapering inward from said exterior surface to said interior surface.

3. The circuit breaker enclosure of claim 1 wherein said recesses are flanked by intermediate projections having interior and exterior surfaces, said intermediate projections having tapering side walls.

4. The circuit breaker enclosure of claim 3 wherein said projection side walls taper outward from said interior to said exterior surface.

5. The circuit breaker enclosure of claim 4 wherein said dovetail projections nest within said recesses, wherein said tapering edges on said dovetail projections abut said tapering edges on said intermediate projections.

6. The circuit breaker enclosure of claim 1 including metal reinforcing means within said dovetail projections.

7. The circuit breaker enclosure of claim 6 wherein said metal reinforcing means comprises a U-shaped configuration.

8. The circuit breaker enclosure of claim 7 wherein said U-shaped configuration includes a pair of planar side legs joined by a planar bight member.

9. The circuit breaker enclosure of claim 8 including a torque extending from said bight member and projecting within one of said dovetail extensions.

10. The circuit breaker enclosure of claim 7 wherein said U-shaped configuration defines a plurality of holes for receiving plastic material during manufacture of said cover.

11. The circuit breaker enclosure of claim 10 including a tang extending from said U-shaped configuration for positioning said U-shaped configuration within said cover.

12. The circuit breaker enclosure of claim 5 wherein a bottom of each of said dovetail projections and a bottom of each of said recesses define a predetermined gap therebetween, said predetermined gap thereby allowing passage of gas from an interior to an exterior of said enclosure.

* * * * *